US007554786B2

(12) United States Patent
Kramer et al.

(10) Patent No.: US 7,554,786 B2
(45) Date of Patent: Jun. 30, 2009

(54) ELECTRONIC DISABLING DEVICE HAVING A NON-SINUSOIDAL OUTPUT WAVEFORM

(75) Inventors: Michael Kramer, Casper, WY (US); Corey Rutz, Casper, WY (US)

(73) Assignee: Defense Technology Corporation of America, Casper, WY (US)

( * ) Notice: Subject to any disclaimer, the term of this patent is extended or adjusted under 35 U.S.C. 154(b) by 334 days.

(21) Appl. No.: 11/359,251

(22) Filed: Feb. 21, 2006

(65) Prior Publication Data

US 2006/0255775 A1 Nov. 16, 2006

Related U.S. Application Data

(60) Provisional application No. 60/657,294, filed on Feb. 28, 2005, provisional application No. 60/655,145, filed on Feb. 22, 2005.

(51) Int. Cl.
*F41B 15/04* (2006.01)

(52) U.S. Cl. ..... 361/232

(58) Field of Classification Search ..... 361/232
See application file for complete search history.

(56) References Cited

U.S. PATENT DOCUMENTS 3,803,463 A 4/1974 Cover
4,872,084 A * 10/1989 Dunning et al. ..... 361/232
5,193,048 A * 3/1993 Kaufman et al. ..... 361/232
7,102,870 B2 * 9/2006 Nerheim ..... 361/232
2006/0168872 A1 * 8/2006 Locklear ..... 43/17.1

* cited by examiner

*Primary Examiner*—Stephen W Jackson
*Assistant Examiner*—Dharti H Patel
(74) *Attorney, Agent, or Firm*—Christie, Parker & Hale, LLP

(57) ABSTRACT

A system and/or an associated method for providing an electronic disabling device with an output having an output waveform other than a sinusoidal waveform (e.g., a damped waveform, a critically damped waveform, a half-cycle uni-pulse output waveform, etc.) and/or for providing the electronic disabling device that can selectively apply the half-cycle uni-pulse output waveform and a sinusoidal output waveform in one device package. In one embodiment, an electronic disabling device includes a power supply coupled to receive an initial power from a battery and a final step-up transformer (e.g., a plain transformer, an autoformer, etc.) adapted to provide an output power having a non-sinusoidal output waveform. In this embodiment, a bridge rectifier is coupled between the power supply and the final step-up transformer to produce the non-sinusoidal output waveform.

7 Claims, 10 Drawing Sheets

ELECTRONIC DISABLING DEVICE HAVING A NON-SINUSOIDAL OUTPUT WAVEFORM

CROSS-REFERENCE TO RELATED APPLICATIONS

This application claims priority to and the benefit of U.S. Provisional Application No. 60/655,145, filed on Feb. 22, 2005, and U.S. Provisional Application No. 60/657,294, filed on Feb. 28, 2005, the entire contents of both of which are incorporated herein by reference.

FIELD OF THE INVENTION

The present invention relates generally to the field of an electronic disabling device for immobilizing a live target. More specifically, the present invention is related to an electronic disabling device having a non-sinusoidal output waveform and a method for providing the same.

BACKGROUND OF THE INVENTION

An electronic disabling device can be used to refer to an electrical discharge weapon or a stun gun. The electrical discharge weapon connects a shocking power to a live target by the use of darts projected with trailing wires from the electrical discharge weapon. The shocks debilitate violent suspects, so peace officers can more easily subdue and capture them. The stun gun, by contrast, connects the shocking power to the live target that is brought into direct contact with the stun gun to subdue the target. Electronic disabling devices are far less lethal than other more conventional weapons such as firearms.

In general, the basic ideas of the above described electronic disabling devices are to disrupt the electric communication system of muscle cells in a live target. That is, an electronic disabling device generates a high-voltage, low-amperage electrical charge. When the charge passes into the live target's body, it is combined with the electrical signals from the brain of the live target. The brain's original signals are mixed in with random noise, making it very difficult for the muscle cells to decipher the original signals. As such, the live target is stunned or temporarily paralyzed. The current of the charge may be generated with a pulse frequency that mimics a live target's own electrical signal to further stun or paralyze the live target.

To dump this high-voltage, low-amperage electrical charge, the electronic disabling device includes a shock circuit having multiple transformers and/or autoformers that boost the voltage in the circuit and/or reduce the amperage. The shock circuit may also include an oscillator to produce a specific pulse pattern of electricity and/or frequency.

Current electronic disabling devices take the lower voltage, higher current of a battery or batteries and convert it into a higher voltage, lower current output. This output must contact an individual in two places to create a full path for the energy to flow. For stun guns, this output is provided to two metal contacts on the contacting side of the device that are a short distance apart. On the electronic discharge weapons, this output is provided to two metal darts (or probes) that are propelled into the live target (or individual). The distance between the probes is normally larger than the stun gun contacts to allow for a greater effect of the live target. The metal probes are connected to the electrical circuitry in the device by thin conducting wires that carry the energy from/to the device and from/to the metal probes.

Typically, an electronic disabling device produces an output having a sinusoidal output waveform with positive and negative amplitudes as shown in FIG. 1. This indicates that the electrons will first flow in a first direction, and a substantial number of the electrons will then flow in a second, opposite direction. That is, the negative (or opposite) amplitude in the sinusoidal output waveform shown in FIG. 1 is mainly caused by the electrons flowing in the opposite direction for a part of the cycle of the waveform. Therefore, a larger than necessary amount of electrons flowing in the opposite direction may be used on a person that could have been sufficiently immobilized by the electrons flowing in the first direction.

In view of the foregoing, it would be desirable to create an electronic disabling device for immobilization and capture of a live target having a half-cycle uni-pulse output waveform as shown in FIG. 2 and/or having an output waveform other than a sinusoidal output waveform (a non-sinusoidal output waveform) as, e.g., shown in FIGS. 2 and 10. In addition, it would be desirable to provide an electronic disabling device that can selectively apply a sinusoidal output waveform and a uni-pulse output waveform such that the electronic disabling device does not apply an output waveform to a live target that might possibly be unsafe to that particular individual.

SUMMARY OF THE INVENTION

The present invention relates to a system and/or an associated method for providing an electronic disabling device with an output having an output waveform other than a sinusoidal waveform (e.g., a damped waveform, a critically damped waveform, a half-cycle uni-pulse output waveform, etc.) and/or for providing the electronic disabling device that can selectively apply the half-cycle uni-pulse output waveform and a sinusoidal output waveform in one device package. This would allow a user of the electronic disabling device to start with the half-cycle uni-pulse output waveform and if the half-cycle uni-pulse output wave was not effective, change to the sinusoidal output waveform. This adds a level of safety such that the user does not apply an output waveform to a live target that might possibly be unsafe to that particular individual.

In one exemplary embodiment of the present invention, an electronic disabling device for producing a non-sinusoidal output waveform to immobilize a live target is provided. The electronic disabling device includes a battery, a power supply, a final step-up transformer (e.g., a plain transformer, an autoformer, etc.), a first electrical output contact, a second electrical output contact, and a bridge rectifier. The power supply is coupled to receive an initial power from the battery. The final step-up transformer is adapted to provide an output power having the non-sinusoidal output waveform. The first electrical output contact is coupled to receive the output power having the non-sinusoidal output waveform from the final step-up transformer. The second electrical output contact is coupled to receive the output power having the non-sinusoidal output waveform from the first electrical output through the live target. In addition, the bridge rectifier is coupled between the initial step-up voltage circuit and the final step-up transformer to produce the non-sinusoidal output waveform.

In one exemplary embodiment of the present invention, a method provides an electronic disabling device with a non-sinusoidal output waveform to immobilize a live target. The method includes: providing an input power from a battery to a power supply; stepping-up a voltage of the input power through the power supply; rectifying and transforming the input power to an output power through a bridge rectifier and a final step-up transformer (e.g., a plain transformer, an autoformer, etc.) to produce the non-sinusoidal output waveform; and providing the output power having the non-sinusoidal output waveform to an electrical output contact.

In one exemplary embodiment of the present invention, a method provides an electronic disabling device with an output waveform to immobilize a live target. The method includes: selecting a half-cycle uni-pulse waveform or a sinusoidal waveform as the output waveform of the electronic disabling device; providing an input power from a battery to a power supply; stepping-up a voltage of the input power through the power supply; rectifying and transforming the input power to an output power through a bridge rectifier and a final step-up transformer (e.g., a plain transformer, an autoformer, etc.) to produce the selected output waveform; and providing the output power having the selected output waveform to an electrical output contact.

A more complete understanding of the electronic disabling device having a non-sinusoidal output waveform (e.g., a damped waveform, a critically damped waveform, a half-cycle uni-pulse output waveform, etc.) will be afforded to those skilled in the art and by a consideration of the following detailed description. Reference will be made to the appended sheets of drawings which will first be described briefly.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
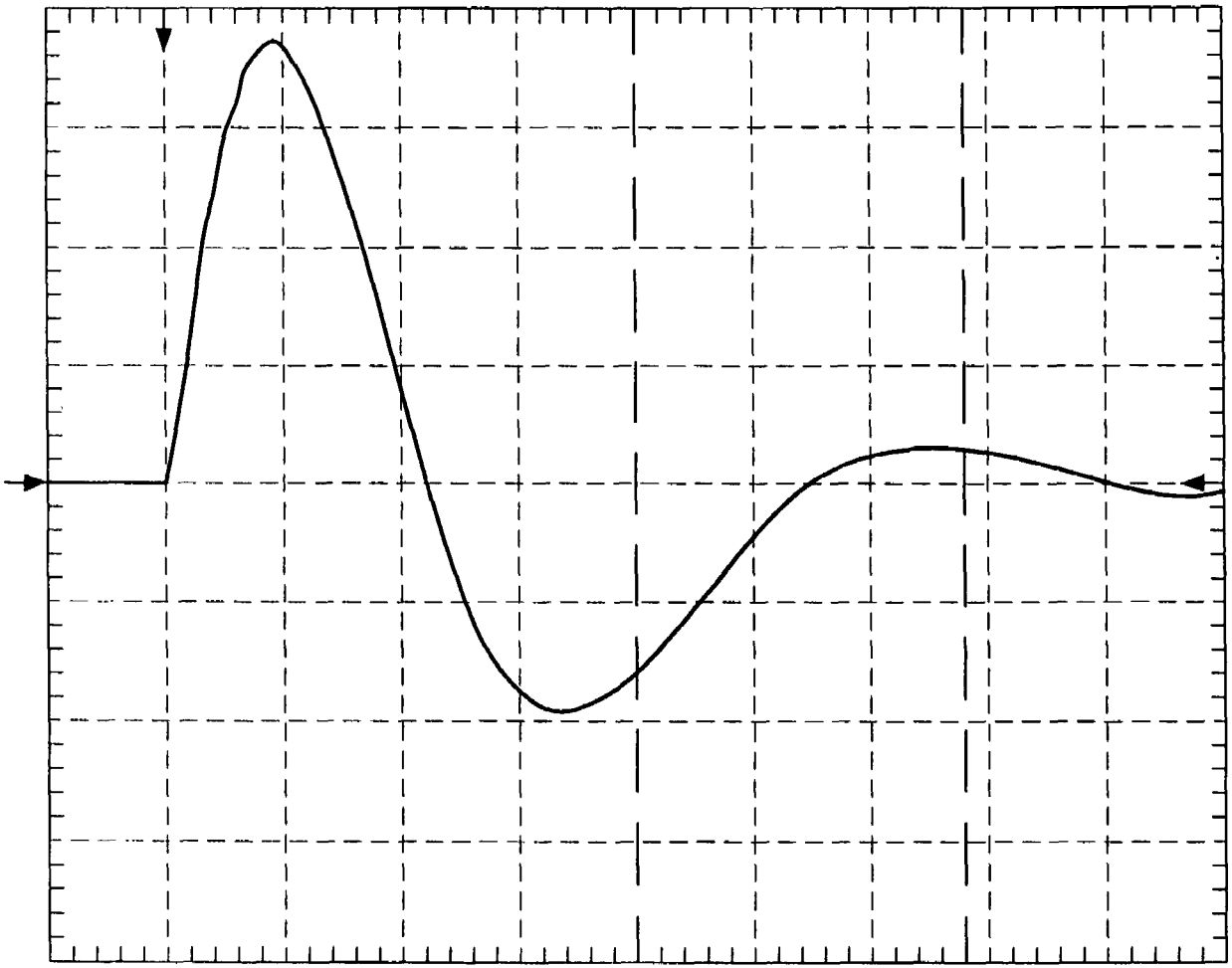
FIG. 1 illustrates an exemplary sinusoidal output waveform.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

There may be parts shown in the drawings, or parts not shown in the drawings, that are not discussed in the specification as they are not essential to a complete understanding of the invention. Like reference numerals designate like elements.

Figure 3:
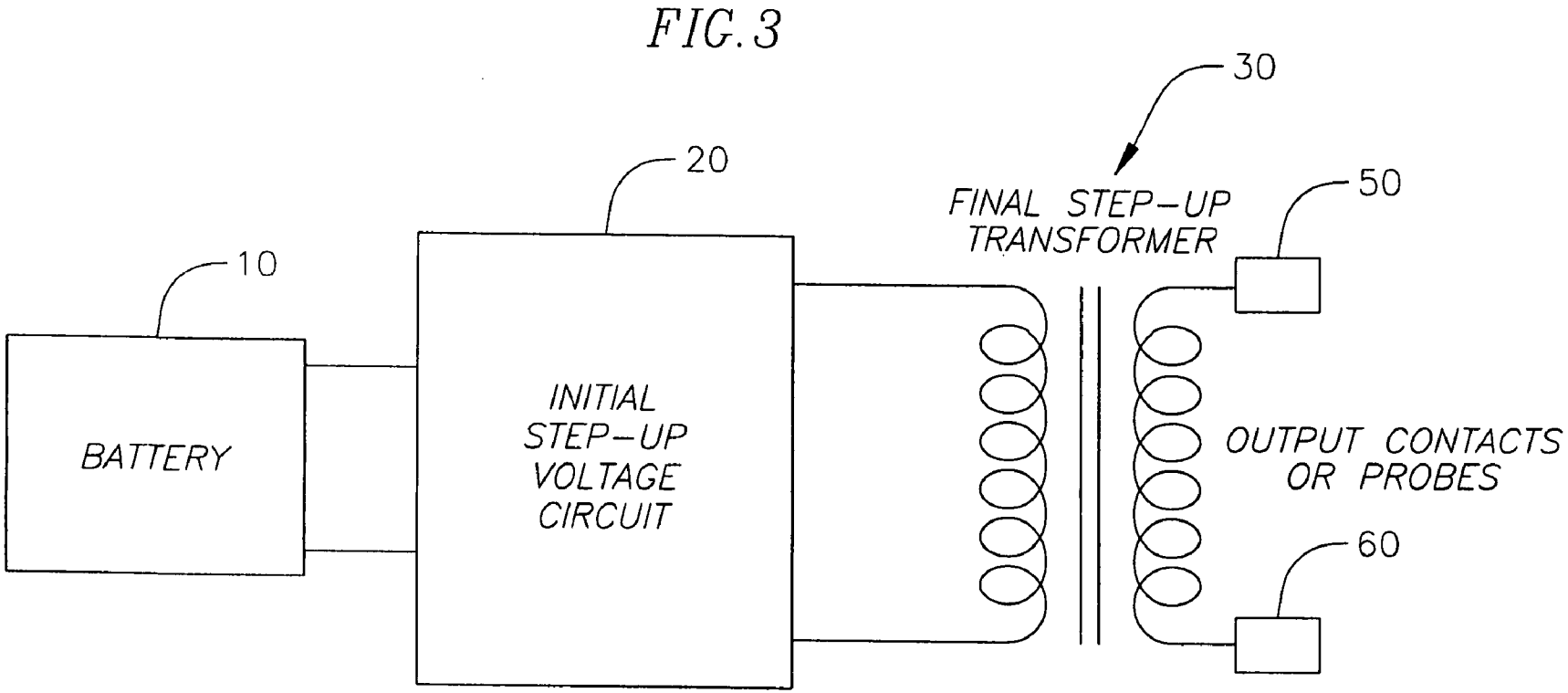
FIG. 3 illustrates an exemplary electronic disabling device.

Referring to FIG. 3, an example of an electronic disabling device is shown to include a battery 10, an initial step-up voltage circuit 20, a trigger (not shown), a final step-up transformer 30, a first electrically conductive output contact (or probe) 50, and a second electrically conductive output contact (or probe) 60. Each of the contacts 50, 60 can be connected to the housing of the electronic disabling device by electrically conductive wires. Further, although the final step-up transformer 30 is exemplary shown in FIG. 3 as being a plain transformer, it should be recognized by those skilled in the art that the present invention is not thereby limited. For example, a final step-up transformer according to an embodiment of the present invention can be realized as being an autoformer.

In operation, an electrical charge which travels into the contact 50 is activated by squeezing the trigger. The power for the electrical charge is provided by the battery 10. That is, when the trigger is turned on, it allows the power to travel to the initial step-up voltage circuit 20. The initial step-up voltage circuit 20 includes a first transformer that receives electricity from the battery 10 and causes a predetermined amount of voltage to be transmitted to and stored in a storage capacitor through a number of pulses. Once the storage capacitor stores the predetermined amount of voltage, it is able to discharge an electrical pulse into the final step-up transformer 30 (e.g., a second transformer and/or autoformer). The output from the final step-up transformer 30 then goes into the first contact 50. When the first and second contacts 50, 60 contact a live target, charges from the first contact 50 travel into tissue in the target's body, then through the tissue into the second contact 60, and then to a ground. Pulses are delivered from the first contact 50 into target's tissue for a predetermined number of seconds. The pulses cause contraction of skeletal muscles and make the muscles inoperable, thereby preventing use of the muscles in locomotion of the target.

In one embodiment, the shock pulses from an electronic disabling device can be generated by an oscillator such as a classic relaxation oscillator that produces distorted saw-tooth pulses to the storage capacitor. An electronic disabling device having the relaxation oscillator is shown as FIG. 4.

Figure 4:
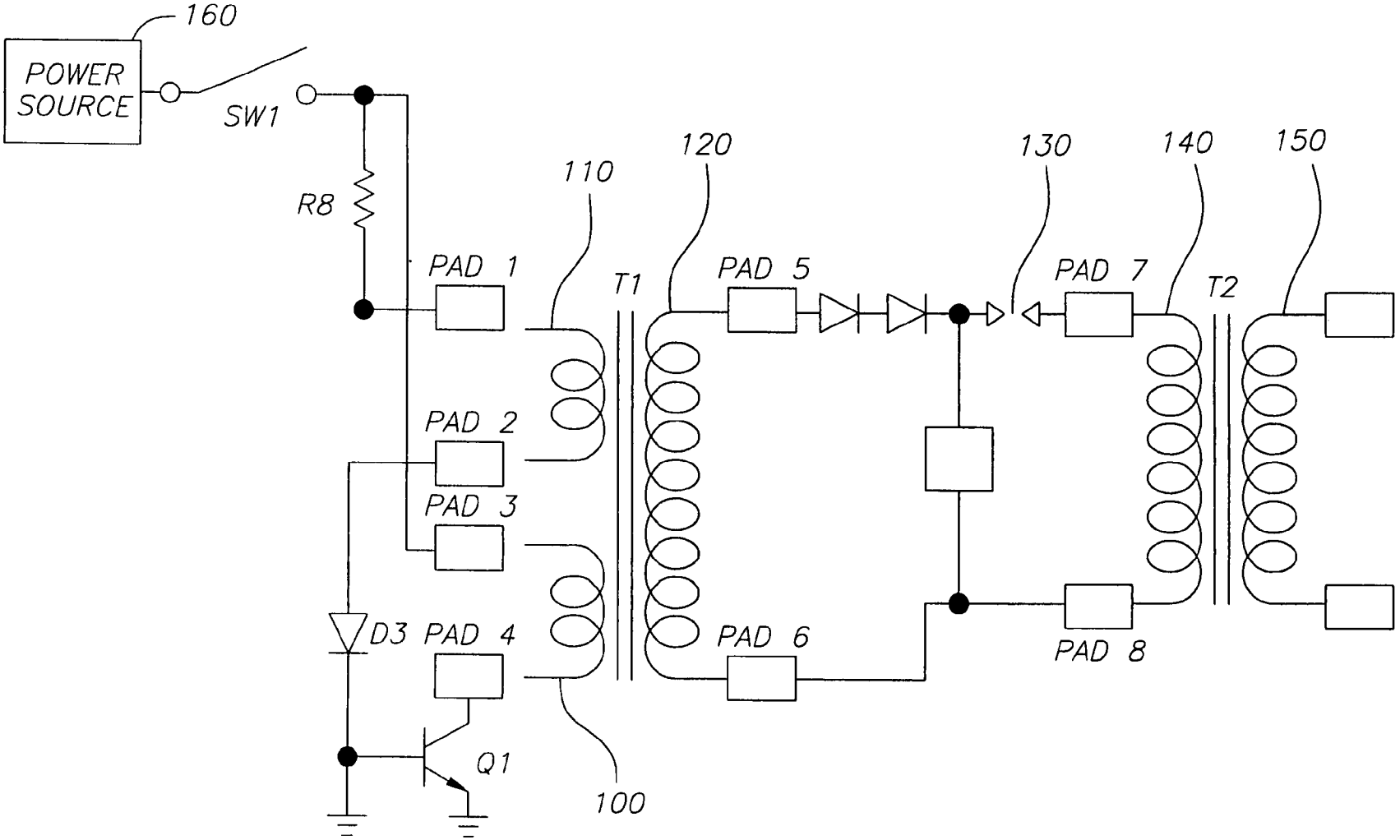
FIG. 4 illustrates an exemplary electronic disabling device using a relaxation oscillator.

Referring to FIG. 4, power is supplied to the relaxation oscillator from a battery source 160. The closure of a switch SW1 connects the battery source 160 with an inverter transformer TI. In FIG. 4, a tickler coil 110 of the inverter transformer T1 between PAD1 and PAD2 is used to form the classic relaxation oscillator. A primary coil 100 of the inverter transformer T1 is connected between PAD3 and PAD4. Upon closure of the power switch SW1, the primary coil 100 of the inverter transformer T1 is energized as a current flows through the coil 100 from PAD3 to PAD4 as the power transistor Q1 is turned ON. The tickler coil 110 of the inverter transformer T1 is energized upon closure of the power switch SW1 through a resistor R8 and a diode D3. The current through the tickler coil 110 also forms the base current of the power transistor Q1, thus causing it to turn ON. Since the tickler coil 110 and the primary coil 100 of the inverter transformer T1 oppose one another, the current through power transistor Q1 causes a flux in the inverter transformer T1 to, in effect, backdrive the tickler coil 110 and cut off the power transistor Q1 base current, thus causing it to turn OFF and forming the relaxation oscillator.

In addition, a secondary coil 120 of the inverter transformer T1 between PAD5 and PAD6 is connected to a pair of diodes D4 and D5 that form a half-wave rectifier. The pair of diodes D4 and D5 are then serially connected with a spark gap 130 and then with a primary coil 140 of the output transformer T2. The primary coil 140 of the output transformer T2 is connected between PAD7 and PAD8. The spark gap 130 is selected to have particular ionization characteristics tailored to a specific spark gap breakover voltage to "tune" the output of the shock circuit.

In more detail, when sufficient energy is charged on a storage capacitor, a gas gap breaks down on the spark gap 130 such that the spark gap 130 begins to conduct electricity. This energy is then passed through the primary coil 140 of output or step-up transformer T2.

However, the present invention is not limited to the above described exemplary oscillator embodiment. For example, an embodiment of an electronic disabling device can include a digital oscillator coupled to digitally generate switching signals or an independent oscillator 210 as shown in FIG. 5.

Figure 5:
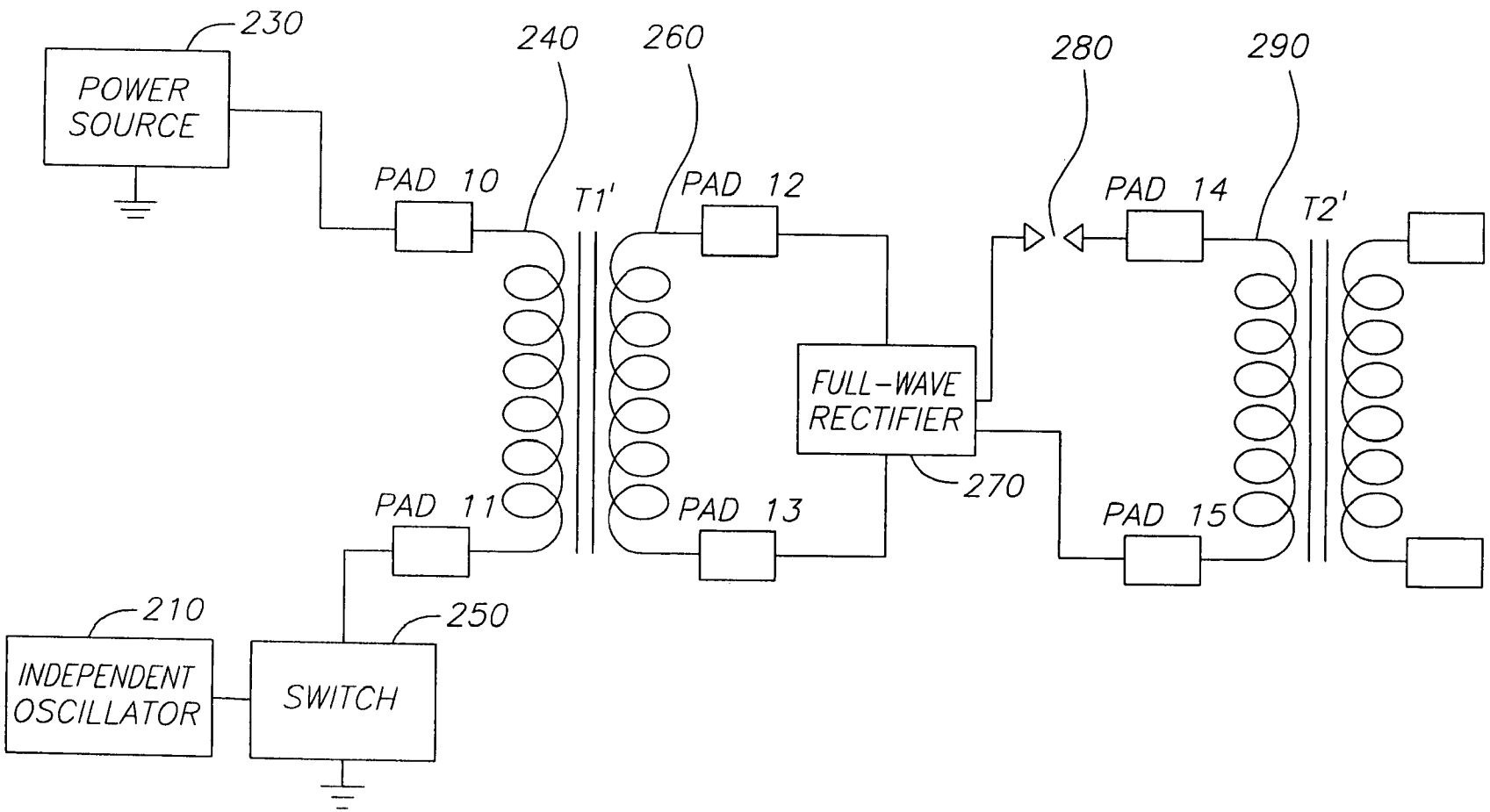
FIG. 5 illustrates an exemplary electronic disabling device using an independently driven oscillator.

In the disabling device of FIG. 5, a power is supplied from a battery source 230 to an inverter transformer TI'. In FIG. 5, a primary coil 240 of the inverter transformer T1' is connected between PAD10 and PAD11. A power switch 250 is connected between the inverter transformer T1' and a ground. The power switch 250 (or a base or a gate of the power switch 250) is also connected to the independent oscillator 210.

In more detail, the primary coil 240 of the inverter transformer T1' is energized as current flows through the coil 240 from PAD10 to PAD11 as the switch (or transistor) 250 is turned ON. The independent oscillator 210 is coupled to the switch 250 (e.g., at the base or the gate of the switch 250) to turn the switch 250 ON and OFF. A secondary coil 260 of the inverter transformer T1' between PAD12 and PAD13 is connected to a full-wave rectifier 270. The full-wave rectifier 270 is then serially connected with a spark gap 280 and then with a primary coil 290 of the output transformer T2'. The primary coil 290 of the output transformer T2' is connected between PAD14 and PAD15.

In operation, the oscillator 210 creates a periodic output that varies from a positive voltage (V+) to a ground voltage. This periodic waveform creates the drive function that causes current to flow through the primary coil 240 of the transformer T1'. This current flow causes current to flow in the secondary coil 260 of the transformer T1' based on the turn ratio of the transformer T1'. A power current from the battery source 230 then flows in the primary coil 240 of the transformer T1' only when the switch 250 is turned on and is in the process of conducting. The full wave bridge rectifier 270 then rectifies the voltage from the power source 230 when the switch 250 is caused to conduct.

In view of the foregoing, electronic disabling devices with high powered sinusoidal output waveforms can be formed. However, the propriety of forming weapons capable of producing such high powered sinusoidal output waveforms may be in question because the sinusoidal output waveforms may increase the weapons lethality, especially where a circuit operating at an output waveform other than an sinusoidal output waveform (e.g., a damped waveform, a critically damped waveform, a half-cycle uni-pulse output waveform, etc.) can completely disable most test subjects. In addition, some seventy deaths have occurred proximate to use of such weapons. As such, using these weapons at only sinusoidal output waveforms may run contrary to the idea that electronic disabling devices are intended to subdue and capture live targets without seriously injuring them.

In accordance with an embodiment of the present invention, an electronic disabling device produces an output waveform other than a sinusoidal output waveform (e.g., a damped waveform, a critically damped waveform, a half-cycle uni-pulse output waveform, etc.) and/or can selectively apply the half-cycle uni-pulse output waveform and a sinusoidal output waveform in one device package. This would allow a user of the electronic disabling device to start with the half-cycle uni-pulse output waveform and if the half-cycle uni-pulse output wave was not effective, change to the sinusoidal output waveform. This adds a level of safety such that the user does not apply an output waveform to a live target that might possibly be unsafe to that particular individual.

Figure 6:
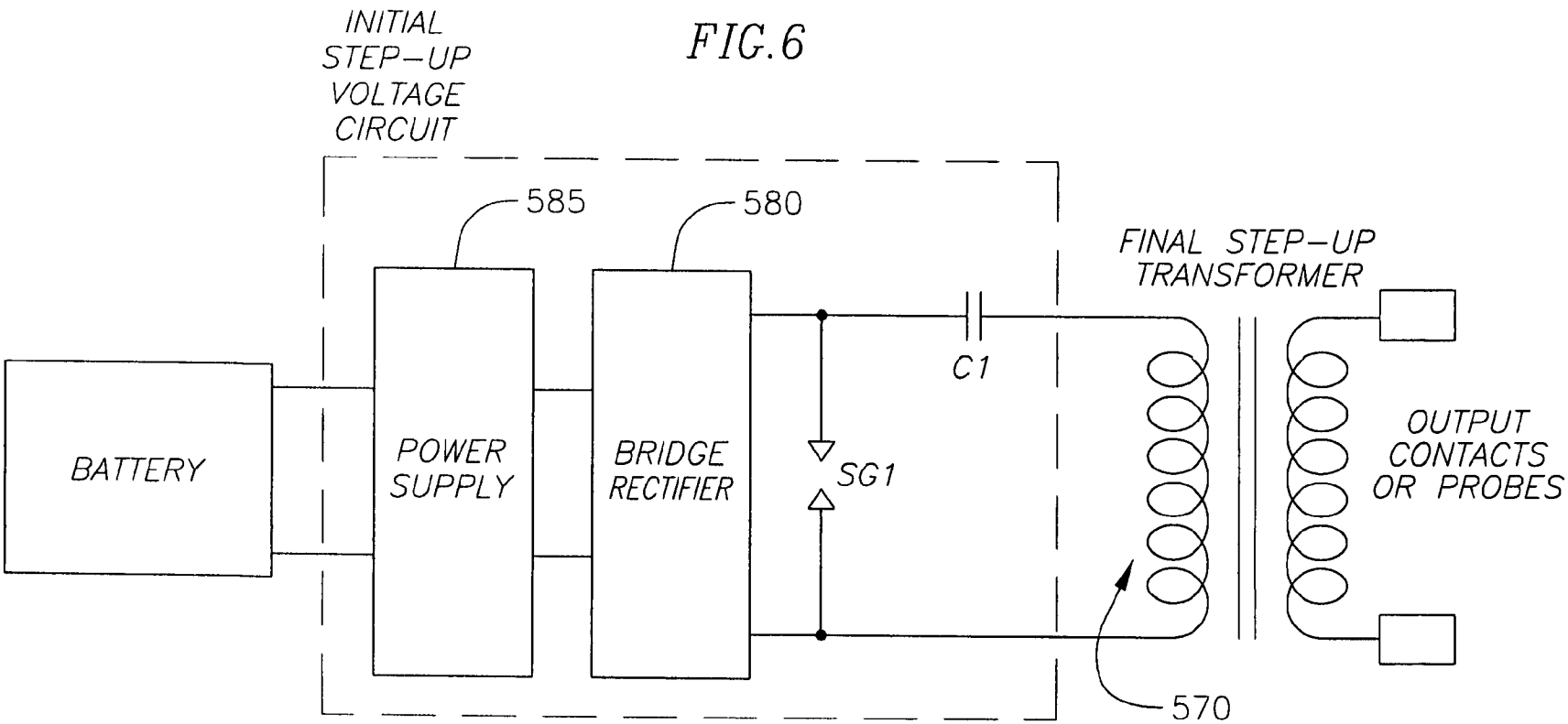
FIG. 6 illustrates an exemplary electronic disabling device for producing a sinusoidal output waveform.

FIG. 6 shows a view into an initial step-up circuit of an electronic disabling device connected with a final step-up transformer of the electronic disabling device. The initial step-up circuit includes a power supply 585 having an oscillator (e.g., the oscillator shown in FIG. 4 or 5 for providing a pulse rate), a bridge rectifier 580, a spark gap SG1, and a storage capacitor C1. Here, the storage capacitor C1 is connected to a primary coil 570 of the final step-up transformer in series, and the spark gap SG1 is connected to the storage capacitor C1 and the primary coil 570 in parallel. As such, the spark gap SG1 and the storage capacitor C1 are positioned to provide a sinusoidal output waveform as shown in FIG. 1.

In more detail, an energy from the bridge rectifier 580 of the initial step-up voltage circuit (e.g., a full-wave bridge rectifier circuit having at least four diodes) is initially used to charge up one plate of the storage capacitor C1. The spark gap SG1 fires whenever the voltage of the storage capacitor C1 reaches a fixed breakdown voltage of the spark gap SG1, and the stored energy discharges through the primary coil 570. In addition, because the storage capacitor C1 and the primary coil 570 are connected to create a tank circuit, as the capacitor C1 discharges, the primary coil 570 will try to keep the current in the circuit moving, so it will charge up the other plate of the capacitor C1. Once the field of the primary coil 570 collapses, the capacitor C1 has been partially recharged (but with the opposite polarity), so it discharges again through the primary coil 570. As such, the sinusoidal output waveform as shown in FIG. 1 is provided by the electronic disabling device of FIG. 6.

Figure 7:
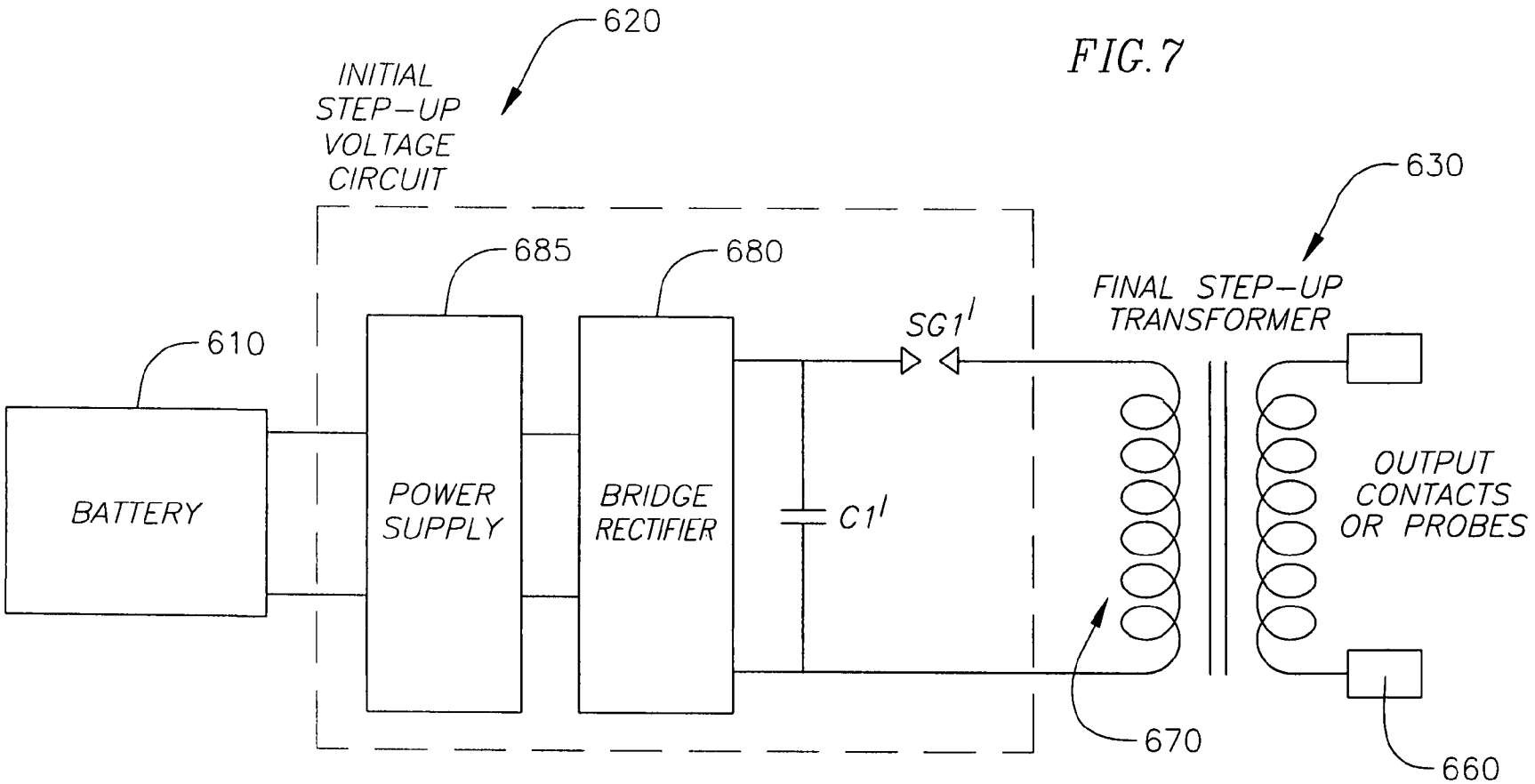
FIG. 7 illustrates an exemplary electronic disabling device for producing a half-cycle uni-pulse output waveform.

Alternatively, referring to FIG. 7, an electronic disabling device in accordance with one embodiment of the present invention includes a battery 610, an initial step-up voltage circuit 620, a trigger (not shown), a final step-up transformer 630, a first electrically conductive output contact (or probe) 650, and a second electrically conductive output contact (or probe) 660. Also, in FIG. 7, the initial step-up circuit includes a spark gap SG1', a storage capacitor C1', a power supply 685 having an oscillator, and a bridge rectifier 680. Here, the spark gap SG1' is connected to a primary coil 670 of the final step-up transformer 670 in series, and the storage capacitor C1' is connected to the spark gap SG1' and the primary coil 670 in parallel. As such, the spark gap SG1' and the storage capacitor C1' are positioned to provide the half-cycle uni-pulse output waveform as shown in FIG. 2.

Figure 2:
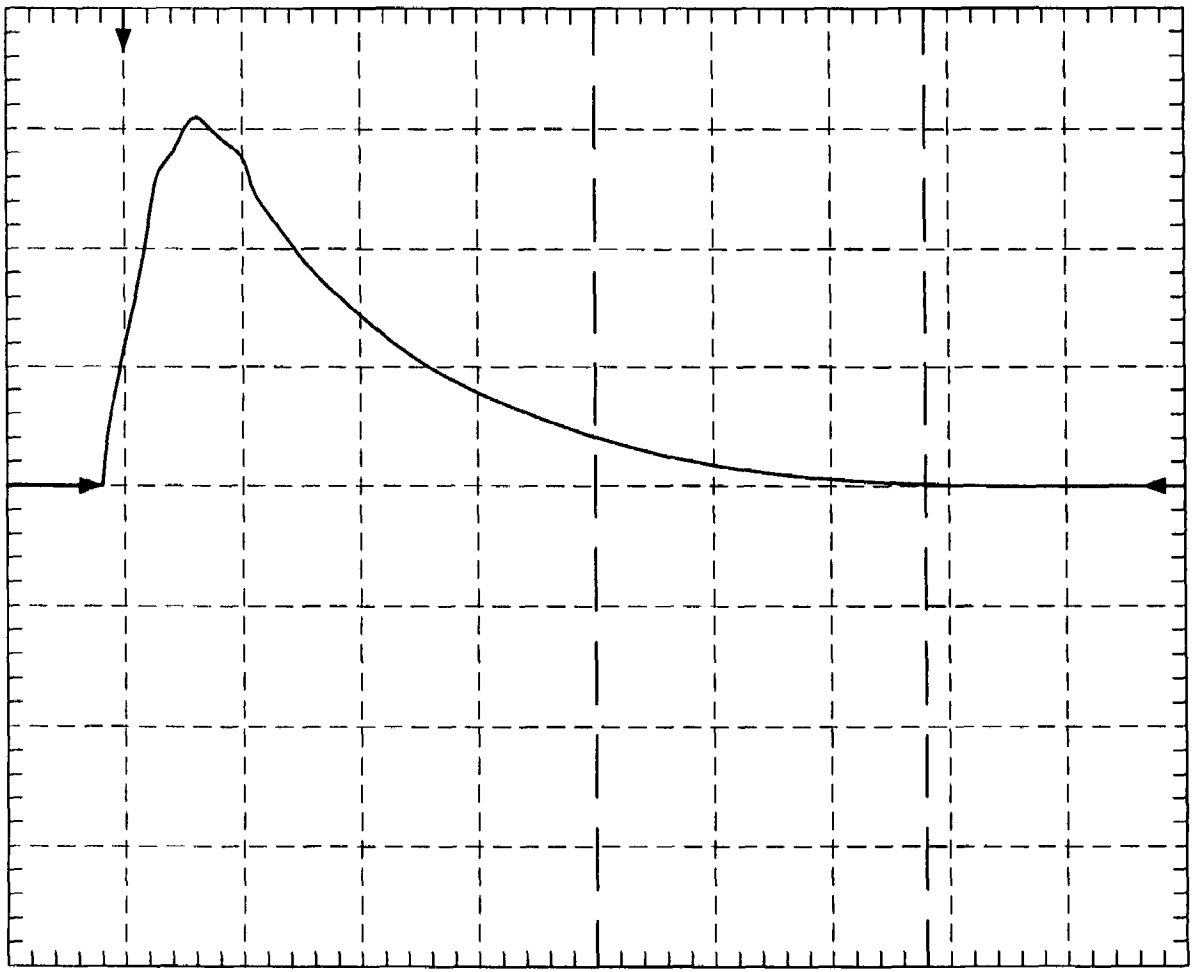
FIG. 2 illustrates an exemplary half-cycle uni-pulse output waveform.

In more detail, the spark gap SG1' and the storage capacitor C1' of FIG. 7 are positionally switched as compared to the spark gap SG1 and the storage capacitor C1 to remove the tank circuit and to produce the half-cycle uni-pulse output waveform as shown in FIG. 2. As such, the electronic disabling device of FIG. 7 produces a mostly positive half-cycle pulse waveform or a mostly negative half-cycle pulse waveform. Also, this indicates that electrons flow mainly in one direction with fewer electrons flowing in the opposite direction. That is, as described above, the opposite amplitude in the sinusoidal output waveform of FIG. 1 is caused by the electrons flowing in the opposite direction for part of the cycle.

Figure 8:
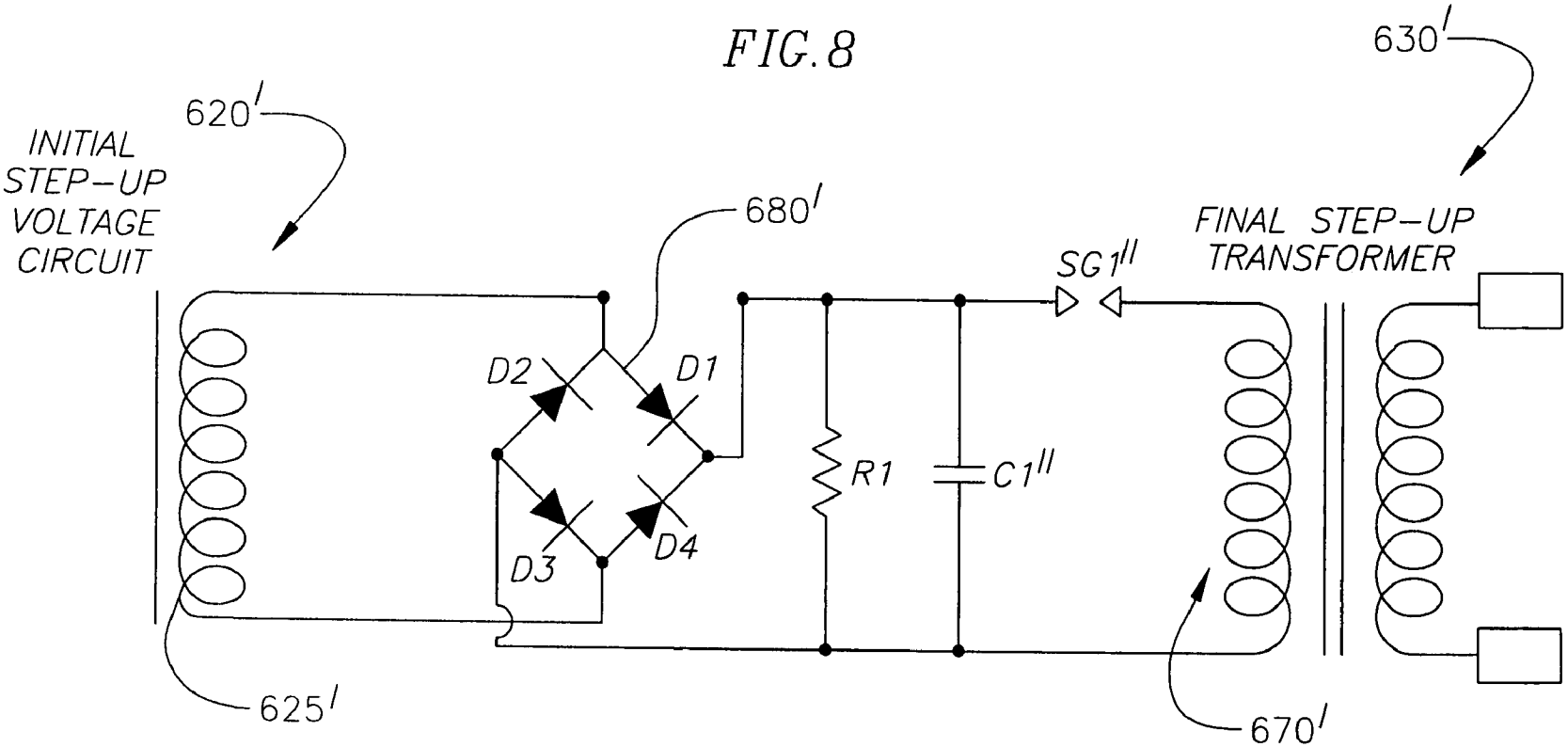
FIG. 8 illustrates another exemplary electronic disabling device for producing a half-cycle uni-pulse output waveform.

Referring to FIG. 8, an electronic disabling device according to a more specific embodiment of the present invention includes a secondary coil 625' of an initial step-up voltage circuit 620. The secondary coil 625' is connected to a first pair of diodes D2 and D4 and a second pair of diodes D1 and D3. The first and second pairs of diodes D1, D2, D3, and D4 form a full-wave rectifier 680'. The bridge rectifier 680' is then serially connected with a spark gap SG1" and-then a primary coil 670' of a final step-up transformer 630'. Here, a resistor R1 and a capacitor C1" are also connected to the spark gap SG1" and the primary coil 670' in parallel. As such, the bridge rectifier 680', the spark gap SG1" and the storage capacitor C1" are positioned to provide the half-cycle uni-pulse output waveform as shown in FIG. 2.

Figure 9:
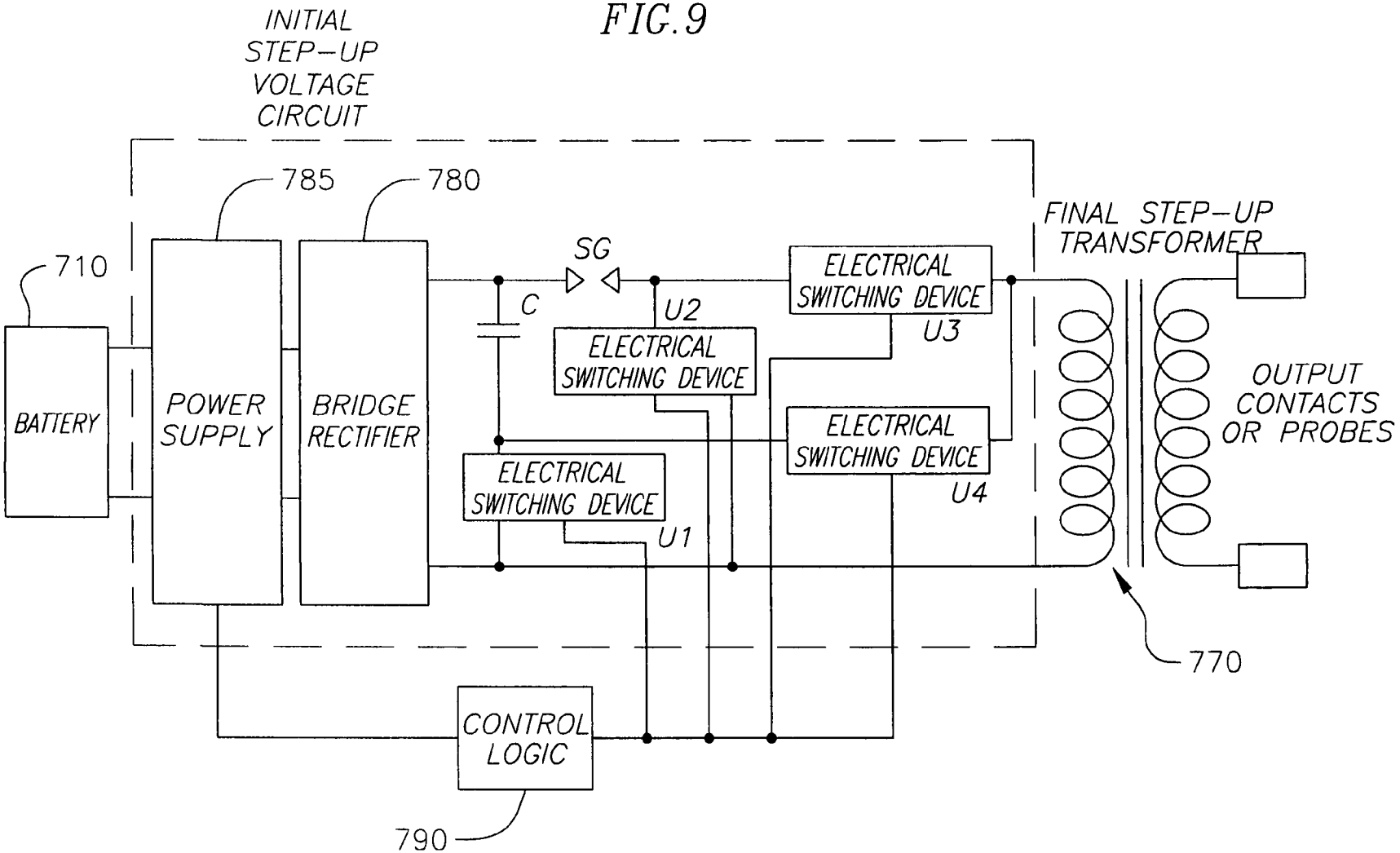
FIG. 9 illustrates an exemplary electronic disabling device for producing a sinusoidal output waveform and a half-cycle uni-pulse output waveform.

Referring to FIG. 9, an electronic disabling device in accordance with another embodiment of the present invention includes a battery 710, a power supply 785, a bridge rectifier circuit 780, a primary coil 770 of a final step-up transformer, and a control logic 790. In addition, the electronic disabling device of FIG. 9 includes a spark gap SG, a storage capacitor C, first electrical switching devices U1 and U3, and second electrical switching devices U2 and U4 to allow on-the-fly changing of the output waveform. That is, the electronic disabling device of FIG. 9 outputs the sinusoidal output waveform (e.g., as shown in FIG. 1) when the first electrical switching devices U1 and U3 are switched on (to create a closed circuit) and the second electrical switching devices U2 and U4 are switched off (to create an opened circuit). By contrast, the electronic disabling device of FIG. 9 outputs the half-cycle uni-pulse output waveform (e.g., as shown in FIG. 2) when the first switching devices U1 and U3 are switched off and the second switching devices U2 and U4 are switched on.

In more detail, when the first electrical switching devices U1 and U3 are switched on (i.e., closed) and the second electrical switching devices U2 and U4 are switched off (i.e., opened), the device of FIG. 9 has a configuration that is substantially the same as the device shown in FIG. 7. That is, the spark gap SG1 is connected to the primary coil 770 in series, and the storage capacitor C is connected to the spark gap SG and the primary coil 770 in parallel to provide the half-cycle uni-pulse output waveform. By contrast, when the second electrical switching devices U2 and U4 are switched on (i.e., closed) and the first electrical switching devices U1 and U3 are switched off (i.e., opened), the device of FIG. 9 has a configuration that is substantially the same as the device shown in FIG. 6. That is, the storage capacitor C is connected to the primary coil 770 in series, and the spark gap SG is connected to the storage capacitor C and the primary coil 770 in parallel to provide the sinusoidal output waveform. In FIG. 9, the control logic 790 is added to control the switching devices U1, U2, U3, and U4 to allow a control input from a user. This control logic 790 would also provide an input to the power supply 785 including an oscillator to keep the same output pulse rate. As such, the electronic disabling device of FIG. 9 can selectively apply the half-cycle uni-pulse output waveform and the sinusoidal output waveform in one device package.

Figure 10:
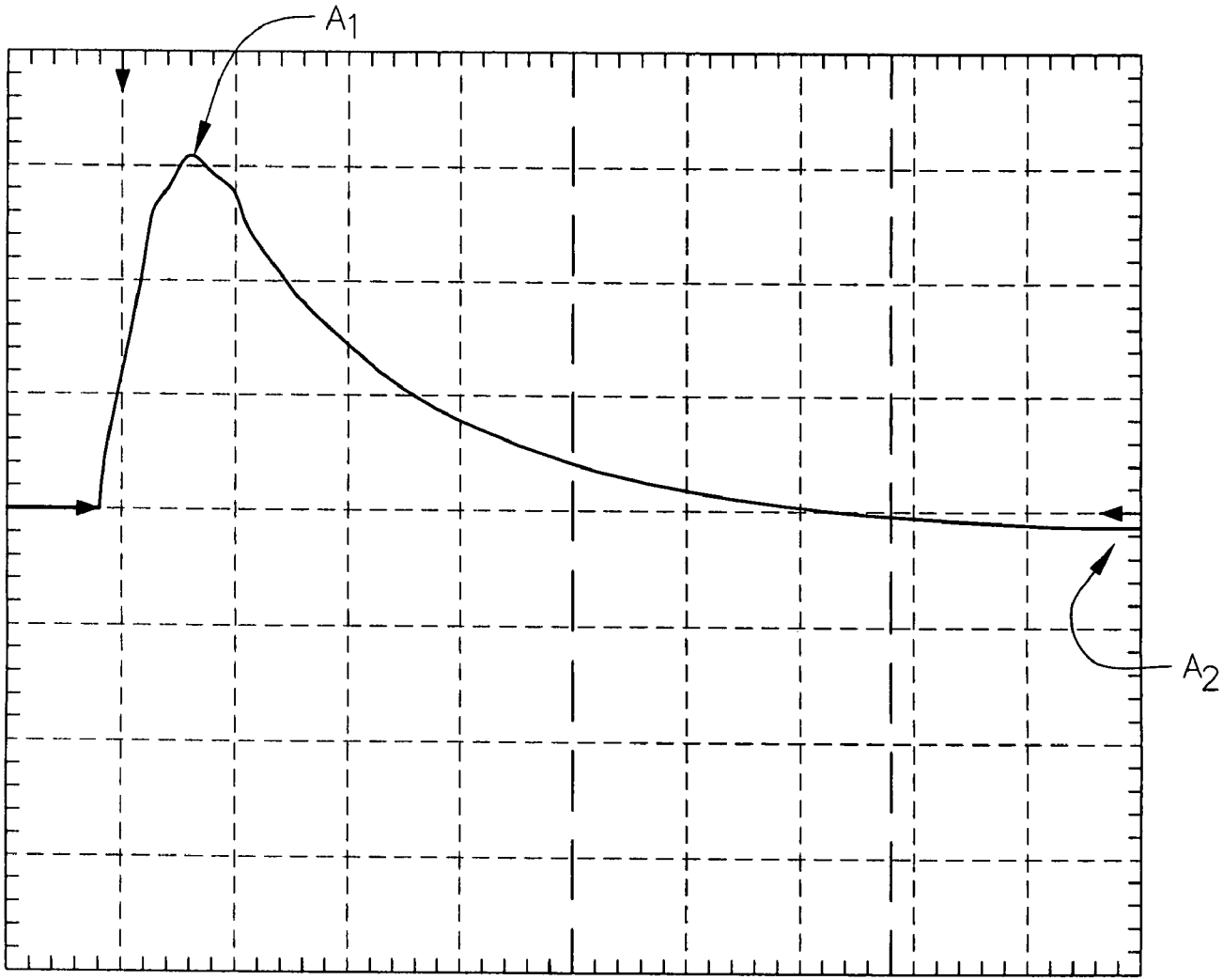
FIG. 10 illustrates an exemplary non-sinusoidal output waveform having a main uni-polar half-cycle pulse followed by an opposite polarity secondary uni-polar half-cycle pulse.

FIG. 10 shows another output waveform other than a sinusoidal output waveform according to an embodiment of the present invention. Here, the output waveform of FIG. 10 includes a first (or main) uni-polar half-cycle pulse followed by an opposite polarity second (or secondary) uni-polar half-cycle pulse. That is, the entire output waveform of FIG. 10 has a first (or peak) amplitude $A_1$ and a second amplitude $A_2$ having an opposite polarity with the first amplitude $A_1$. The second amplitude $A_2$ has an amplitude that is equal to or less (i.e., not greater) than 25 percent of the first (or peak) amplitude $A_1$. In FIG. 10, the first amplitude $A_1$ can be a positive voltage amplitude or a negative voltage amplitude as long as the second amplitude $A_2$ oscillates in the opposite polarity at an amplitude not greater than 25 percent of the first (or peak) amplitude $A_1$.

The output waveform of FIG. 10 can be formed by removing 75 percent or more of the amplitude opposite the peak amplitude. By removing more than 75 percent of peak opposite amplitude from the waveform, a mostly positive or mostly negative half-cycle waveform is formed. Furthermore, this indicates that electrons flow mainly in one direction with fewer electrons flowing in the opposite direction. This is because, referring now also to FIG. 1, the opposite amplitude in the sinusoidal pulse output waveform is caused mainly by the electrons flowing in the opposite direction for a part of the cycle of the sinusoidal pulse output waveform.

In one embodiment, the first (or peak) amplitude $A_1$ is at positive 620 volts and the second amplitude $A_2$ is at 40 volts to produce a half-cycle uni-pulse output waveform with an opposite polarity of about 7 percent.

In view of the foregoing, an electronic disabling device according to an embodiment of the present invention utilizes a rectifier and a non-tank circuit to produce a half-cycle uni-pulse output waveform. Here, the majority of electrons traveling in the opposite polarity of the peak amplitude are in essence filtered or redirected Further, an electronic disabling device according to another embodiment of the present invention can selectively apply a half-cycle uni-pulse output waveform and a sinusoidal output waveform in one device package. This would allow a user of the electronic disabling device to start with the half-cycle uni-pulse output waveform and if the half-cycle uni-pulse output wave was not effective, change to the sinusoidal output waveform.

In addition, as shown in FIGS. 2 and 10, an electronic disabling device according to an embodiment of the present invention outputs: (1) a half-cycle uni-polar pulse, followed by a slow uni-polar pulse of the opposite polarity; (2) a half-cycle uni-polar pulse waveform in which amplitude oscillates to peak in one direction and exhibits a uni-polar pulse of the opposite polarity with less than 25% of the peak amplitude; (3) a half-cycle uni-polar pulse, followed by a slow uni-polar pulse of the opposite polarity through a 1000 OHM load to produce a total pulse width between 3 and 50 micro seconds, a peak voltage between 2000 and 20000 volts, between 5-25 pulses per second, between 0.05 and 1 watt contained in a single pulse peak amplitude (joules per pulse), or between 1 and 20 watts per second (joules); or (4) a half-cycle uni-pulse that does not have a uni-polar pulse of the opposite polarity (e.g., as shown in FIG. 2) with a total pulse width between 3 and 50 micro seconds, a peak voltage between 2000 and 20000 volts, between 5-25 pulses per second, between 0.05 and 1 watt contained in a single pulse peak amplitude (joules per pulse), or between 1 and 20 watts per second (joules).

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electronic disabling device for producing a first output waveform to immobilize a live target, the electronic disabling device comprising:

a battery;

a power supply coupled to receive an initial power from the battery;

an final step-up transformer adapted to provide an output power having the first output waveform;

a first electrical output contact coupled to receive the output power having the first output waveform from the final step-up transformer;

a second electrical output contact coupled to receive the output power having the first output waveform from the first electrical output through the live target; and a rectifier coupled to the final step-up transformer to produce the first output waveform; and a spark gap, a storage capacitor, a first electrical switching device, a second electrical switching device, a third electrical switching device, and a fourth electrical switching device, wherein the first and second electrical switching devices are used to couple the spark gap and the storage capacitor with the final step-up transformer to produce the first output waveform and the third and fourth electrical switching devices are used to couple the spark gap and the storage capacitor with the final step-up transformer to produce a second output waveform.

2. The electronic disabling device of claim 1, further comprising a control logic electrically coupled between the power supply and the first and second electrical switching devices to allow a control input from a user of the electronic disabling device.

3. The electronic disabling device of claim 1, wherein the final step-up transformer comprises a primary coil, wherein the first and second electrical switching devices are used to couple the spark gap to the primary coil in series and to couple the storage capacitor to the spark gap and the primary coil in parallel, and wherein the second and third electrical switching devices are used to couple the storage capacitor to the primary coil in series and to couple the spark gap to the storage capacitor and the primary coil in parallel.

4. The electronic disabling device of claim 3, further comprising a control logic electrically coupled between the power supply and the first, second, third, and fourth electrical switching devices to allow a control input from a user of the electronic disabling device.

5. The electronic disabling device of claim 1, wherein the rectifier is a full-wave bridge rectifier.

6. The electronic disabling deice of claim 1, wherein the rectifier is coupled between the power supply and the final step-up transformer.

7. The electronic disabling device of claim 6, wherein the rectifier is a full-wave bridge rectifier.

* * * * *